US006122870A

United States Patent [19]

Marcum

[11] Patent Number: 6,122,870

[45] Date of Patent: Sep. 26, 2000

[54] STACK BAN

[76] Inventor: Roger Marcum, 2919 Footloose Dr., Columbus, Ohio 43231

[21] Appl. No.: 09/175,678

[22] Filed: Oct. 20, 1998

[51] Int. Cl.[7] ..... E04D 13/14

[52] U.S. Cl. ..... 52/219; 52/58; 52/741.4; 4/218; 285/42; 277/314; 277/605; 24/279; 24/280

[58] Field of Search ..... 52/219, 199, 58, 52/60, 741.4; 4/218; 138/99; 285/42, 43, 44, 4, 236, 252, 332.3, 345, 347, 379; 24/279, 280; 277/314, 315, 605, 606, 607, 615, 616

[56] References Cited

U.S. PATENT DOCUMENTS

| | | | |
|---|---|---|---|
| D. 308,008 | 5/1990 | Bissell . | |
| 969,476 | 9/1910 | Holt | 285/43 |
| 1,818,219 | 8/1931 | Goodman et al. | 285/43 |
| 1,844,870 | 2/1932 | Helling | 285/43 |
| 1,861,211 | 5/1932 | Gammeter | 285/379 X |
| 1,883,508 | 10/1932 | Bonday . | |
| 2,314,386 | 3/1943 | Brend | 285/332.3 X |
| 2,809,853 | 10/1957 | Nathan | 285/347 X |
| 3,098,663 | 7/1963 | Dibley | 285/43 |
| 3,677,576 | 7/1972 | Gustafson . | |
| 3,807,110 | 4/1974 | Kaminski | 52/219 |
| 3,813,116 | 5/1974 | Horsley | 285/236 |
| 3,871,145 | 3/1975 | Hatmaker | 52/60 |
| 3,977,137 | 8/1976 | Patry | 52/60 |
| 4,010,578 | 3/1977 | Logsdon | 52/199 X |
| 4,120,129 | 10/1978 | Nagler et al. . | |
| 4,160,347 | 7/1979 | Logsdon | 52/199 |
| 4,199,157 | 4/1980 | Skinner et al. | 277/606 |
| 4,203,190 | 5/1980 | Temple | 285/230 |
| 4,216,981 | 8/1980 | Jensen | 285/347 X |
| 4,265,058 | 5/1981 | Logsdon | 52/199 X |
| 4,387,900 | 6/1983 | Ditcher et al. | 277/606 X |
| 4,478,437 | 10/1984 | Skinner | 277/606 X |
| 4,702,645 | 10/1987 | Skinner et al. | 277/626 X |
| 4,905,353 | 3/1990 | Gari . | |
| 4,927,189 | 5/1990 | Burkit | 285/109 |
| 5,161,806 | 11/1992 | Balsells | 277/605 X |
| 5,226,263 | 7/1993 | Merrin et al. . | |
| 5,261,761 | 11/1993 | Knappert et al. | 285/345 X |
| 5,501,472 | 3/1996 | Brancher et al. | 277/606 |
| 5,531,460 | 7/1996 | Stefansson et al. | 277/615 |

FOREIGN PATENT DOCUMENTS

| | | | |
|---|---|---|---|
| 4207849 | 9/1993 | Germany | 285/236 |
| 1014439 | 12/1965 | United Kingdom | 52/219 |

OTHER PUBLICATIONS

Oetiker, "Hose Clamps and Accessories", 12 page brochure, Jan. 1975.

Applicant installed an early prototype of the invention on his sister's house and a friend's house more than one year prior to filing the present patent application to test the invention. However, the use was not for profit, was out of the view of the public, was limited to two occurrences, and the utility of the invention was not known until the Applicant realized how well the invention has worked.

*Primary Examiner*—Laura A. Callo
*Attorney, Agent, or Firm*—Porter, Wright, Morris & Arthur

[57] ABSTRACT

A stack ban for sealing a pipe and boot extending from a roof of a building is disclosed. The stack ban includes a band of flexible material having a smooth inner surface and an outer surface. The inner surface has a circumference substantially equal to a circumference of the pipe and forms a seal between the pipe and boot. The stack ban is preferably secured in a place by a clamp threaded inside of the band and tightened during the installation process. The band is preferably made of neoprene rubber.

18 Claims, 3 Drawing Sheets

STACK BAN

BACKGROUND OF THE INVENTION

1. Field of Invention

This invention pertains to the art of methods and apparatuses for sealing soil stacks extending from the roofs of houses and buildings, and more specifically to methods and apparatuses for using a neoprene rubber seal to seal soil stacks to prevent water leakage over time.

2. Description of the Related Art

The drainage system of a house, building, or building structure must be equipped with vent lines in order to prevent sewer gases from backing up into the plumbing fixtures, as well as to prevent water from being syphoned from drain traps. Typically, vent lines extend up through holes drilled in the roof of a building structure. Consequently, some means of preventing water from entering through the space between the vent line and the holes must be employed. Typically, this consists of a tapered sleeve or boot that is slipped around the exposed vent lines and seated on the surface of the roof. The joints at upper and lower ends are, in turn, sealed with roofing cement.

Unfortunately, roofing cement used for this application is prone to failure over time, particularly at the joint between the vent line and boot. Failure of the roofing cement creates leaks, and eventually leads to water damage to the structure.

The present invention contemplates an improved method of sealing this type of joint, particularly for use with soil stacks which is simple in design, effective in use, and overcomes the foregoing difficulties and others while providing better and more advantageous overall results.

SUMMARY OF THE INVENTION

In accordance with the present invention, a new and improved sealing apparatus and method is provided which seals soil stacks with a much greater level of durability than the roofing cement currently used for the purpose. The increased durability eliminates short term and long term risks of leaks forming around vent lines and soil stacks.

According to one aspect of the present invention, a method of sealing a pipe extending from a roof of a building with a stack ban, the stack ban including a clamp, tightening apparatus, and sealing apparatus, includes the steps of placing a boot over the pipe, fitting the stack ban to seal the boot and the pipe, tightening the tightening apparatus to secure the stack ban, and fitting the sealing apparatus over the tightening apparatus.

According to another aspect of the present invention, a stack ban for sealing a pipe and boot extending from a roof of a building includes a clamp, a tightening apparatus for tightening the clamp, and a sealing apparatus for sealing the pipe and the boot.

According to another aspect of the present invention, a stack ban for sealing a pipe and boot extending from a roof of a building includes a ba nd of flexible neoprene rubber having a smooth inner surface and an outer surface, the smooth inner surface having a circumference substantially equal to a circumference of the pipe, the band forming a seal between the pipe and the boot.

One advantage of the present invention is that the stack ban provides a watertight seal between a soil stack and a boot.

Another advantage of the present invention is that the neoprene rubber of the stack ban does not crack and become brittle when exposed to the elements as does roofing cement.

Another advantage of the present invention is that stack ban may be sized to fit different sized soil stack pipes.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
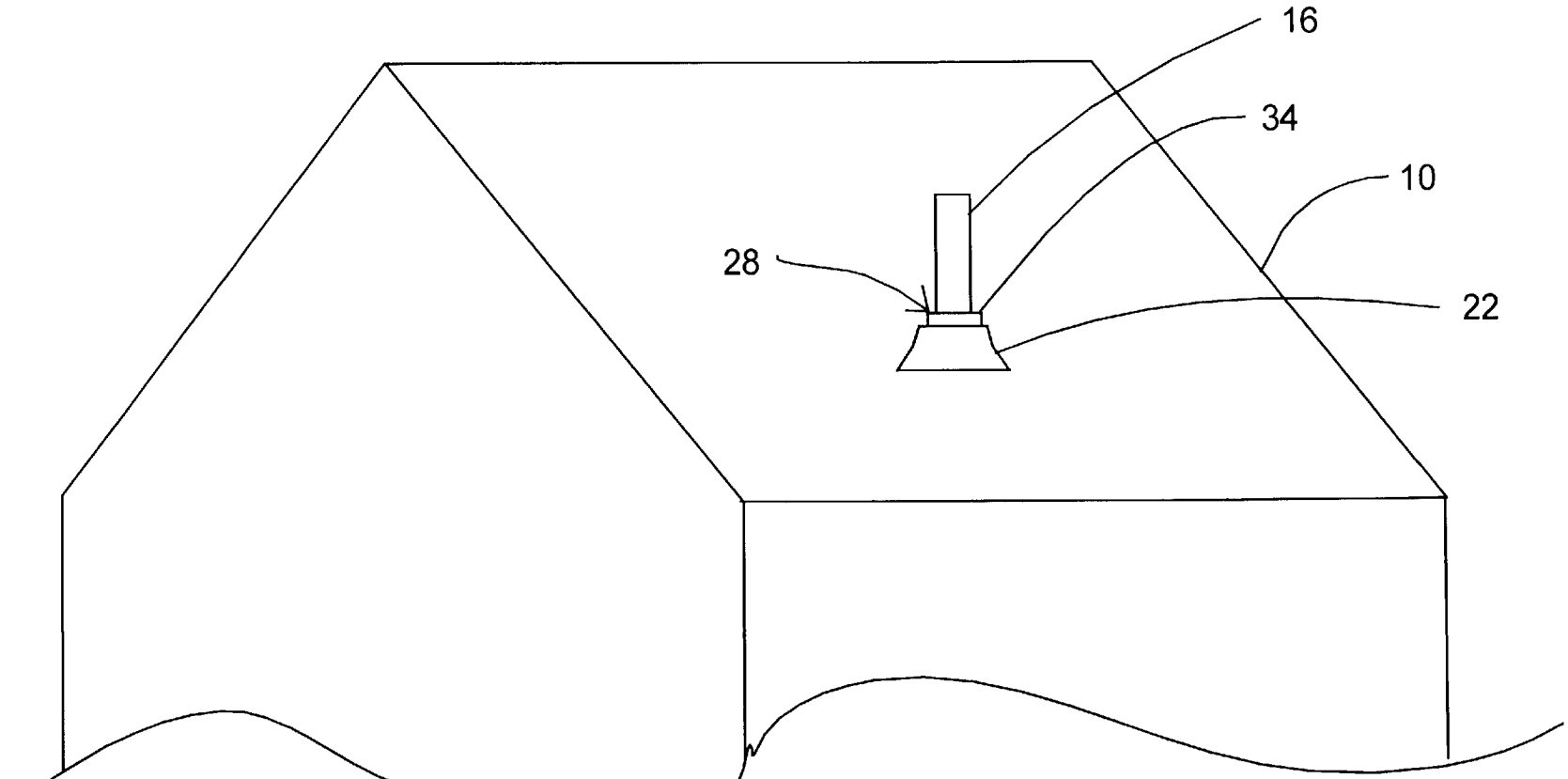
FIG. 1 shows a perspective view of a roof with a soil stack and a stack ban according to the present invention.

Referring now to the drawings wherein the showings are for purposes of illustrating a preferred embodiment of the invention perspective view of the roof 10 of a building structure with a soil stack 16 extending upwardly through the roof 10. A boot 22 is slipped around the exposed soil stack 16 and is seated on the surface of the roof 10. The joint 28 at the top of the boot 22 is preferably sealed with a stack ban 34 according to the present invention.

Figure 2:
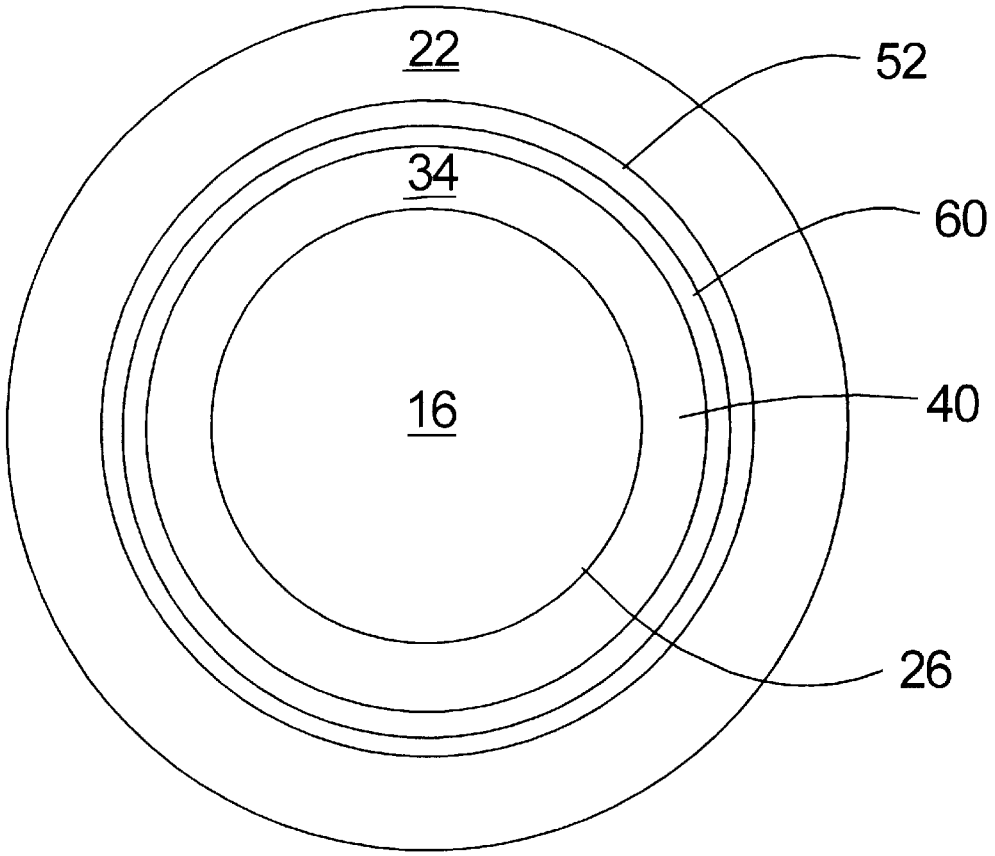
FIG. 2 shows a top view of a stack ban according to the present invention; and, FIG. 3 shows a cross-sectional view of a stack ban according to the present invention.
Figure 3:
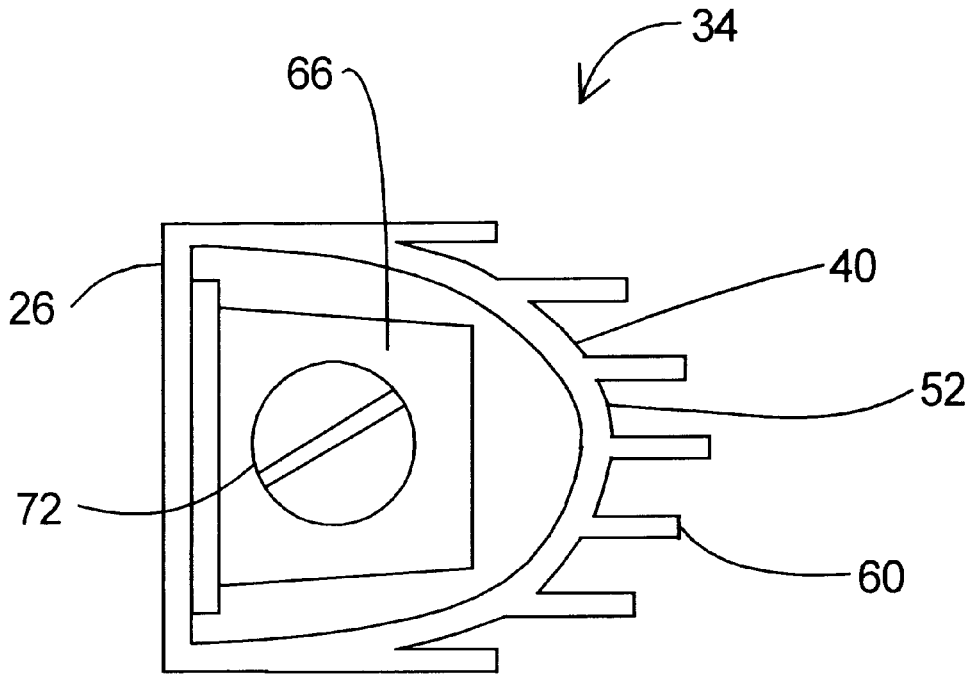

FIG. 2 shows a top view of the stack ban 34, and FIG. 3 shows a cross-section of the stack ban 34. The stack ban 34 consists primarily of a polymerized band 40. The band 40 is preferably made of neoprene rubber, however, other types of rubber or polymers may be used. When the band 40 is formed around the soil stack 16, the inner surface 26 preferably has a circumference substantially equal to the circumference of the soil stack 16, thereby providing for a watertight seal between the stack ban 34 and soil stack 16. The inner surface 26 of the stack ban 34 is preferably smooth and fits snugly against the soil stack 16, thereby providing a watertight seal between the stack ban 34 and the soil stack 16. The stack ban 34 also has a curved, outer surface 52 that preferably contains a plurality of ribs 60 that extend radially from the outer surface 52. While the ribs 60 are not necessary for operation of the stack ban 34, the ribs 60 provide for a watertight joint between the stack ban 34 and the boot 22. In the preferred embodiment, the outer surface 52 of the stack ban 34 preferably has seven ribs 60 spaced approximately 5.0 mm apart. The ribs 60 preferably extend radially approximately 5.0 mm. The circumference of the outer surface 52 should be substantially equal to the circumference of the boot 22.

The smooth inner surface 26 and the rounded outer surface 52 gives the stack ban 34 a cross-sectional D-shape. The stack ban is tightened by a steel worm drive hose clamp 66 located inside of the stack ban 34. While the preferred embodiment of the invention uses a steel worm drive clamp 66, any other type of clamp which securely tightens the stack ban 34 to the soil stack 16 between the soil stack 16 and the boot 22 may also be used.

The stack ban 34 is loosely placed around a soil stack 16 and slipped down until it is put in the place along the soil stack 16 at the joint 28 between the soil stack 16 and boot 22. During assembly, the screw 72 of the steel worm drive hose clamp 66 is exposed, and the screw 72 is tightened until the hose clamp 66 is securely attached between the soil stack 16 and the boot 22. The band 40 is then pulled over the screw 72 to create a complete circle of the band 40 around the soil stack 16.

In an alternate embodiment of the invention, the stack ban 34 may consist solely of a circular, neoprene rubber band 40 with an inner circumference substantially equal to the circumference of the soil stack 16. The stack ban 34 is installed by working the stack ban 34 down the length of the soil stack 16 until the stack ban 34 reaches the joint 28 between the soil stack 16 and boot 22.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention,

It is now claimed:

1. A method of sealing a pipe extending from a roof of a building with a stack ban, said stack ban comprising a clamp, tightening means, and sealing means, said method comprising the steps of:

placing a boot over said pipe;

placing said stack ban over said pipe;

tightening said tightening means to secure said stack ban to the pipe and to form a seal between the stack ban and the pipe;

fitting said sealing means over said tightening means such that the sealing means surrounds the clamp and the tightening means; and engaging said stack ban with the boot to form a seal between the stack ban and the boot after the step of fitting said sealing means over said tightening means.

2. The method of claim 1, wherein said step of fitting said sealing means over said tightening means includes enclosing the clamp and the tightening means in a hollow cavity of the sealing means prior to the step of engaging the stack ban with the boot.

3. A stack ban for sealing a pipe and boot extending from a building, comprising:

a clamp;

tightening means for tightening said clamp; and a band of flexible material having, in cross-section, a continuous wall completely enclosing a hollow interior space, said clamp and said tightening means being located within said hollow interior space.

4. The stack ban of claim 3, wherein said band of flexible material is formed by a tube with said clamp extending within said tube such that said band is surrounding said clamp.

5. The stack ban of claim 4, wherein said flexible material is neoprene rubber.

6. The stack ban of claim 5, wherein said band of flexible material is formed by a tube which is D-shaped in cross-section and located around said clamp.

7. The stack ban of claim 4, wherein said tube is D-shaped in cross section.

8. The stack ban of claim 3, wherein said tightening means comprises: a screw and means for receiving said screw, whereby said clamp is tightened as said screw is tightened.

9. The stack ban of claim 3, wherein said clamp is a worm drive hose clamp.

10. The stack ban of claim 9, wherein said tightening means comprises: a screw and means for receiving said screw, whereby said worm drive hose clamp is tightened as said clamp is tightened.

11. The stack ban of claim 3, wherein said band of flexible material is adapted to surround the clamp prior to installation.

12. A joint comprising:

a pipe extending from a roof of a building;

a boot encircling the pipe and sealed to the roof;

a band of flexible material encircling the pipe and having a smooth inner surface and an outer surface, said smooth inner surface having a circumference substantially equal to a circumference of said pipe such that said band forms a seal between said band and said pipe solely by elastic action of said band of flexible material, said outer surface adapted to form a seal between said band and said boot, wherein said band is made of rubber.

13. The stack ban of claim 12, wherein said band is made of neoprene rubber.

14. The stack ban of claim 12, wherein said band has a D-shaped cross section.

15. The stack ban of claim 14, wherein said band has ribs extending radially from said outer surface to form said seal between said band and said boot.

16. The stack ban of claim 15, wherein said band and said ribs are made of neoprene rubber.

17. The stack ban of claim 12, wherein said outer surface has an outer circumference, said outer circumference being substantially equal to a circumference of said boot.

18. The joint of claim 12, wherein said circumference of the smooth inner surface is sized such that the stack ban must be worked down the length of the pipe.

* * * * *